United States Patent [19]

Davids et al.

[11] Patent Number: 4,991,538

[45] Date of Patent: Feb. 12, 1991

[54] TOWEL COATER AND DISPENSER

[76] Inventors: Orville H. Davids, 3229 Beneva Rd.-103, Sarasota, Fla. 34232; Harold R. Holding, 4306 34th East, Brandenton, Fla. 34208

[21] Appl. No.: 408,458

[22] Filed: Sep. 15, 1989

Related U.S. Application Data

[63] Continuation-in-part of Ser. No. 204,028, Jun. 8, 1988, abandoned.

[51] Int. Cl.[5] ..... B05C 1/12

[52] U.S. Cl. ..... 118/231; 118/249; 118/258; 221/96; 242/55.53; 312/38

[58] Field of Search ..... 221/96; 118/230, 224, 118/231, 37, 43, 200, 235, 294, 246, 49, 258, 221, 225; 312/38, 39, 41; 242/55.53

[56] References Cited

U.S. PATENT DOCUMENTS

| | | | |
|---|---|---|---|
| 410,642 | 9/1889 | Jones | 118/37 |
| 913,614 | 2/1909 | Brownson | 118/43 |
| 2,565,319 | 8/1951 | Newman | 118/419 |
| 3,025,829 | 3/1962 | Smith | 118/249 |
| 3,199,490 | 8/1965 | Karlik | 118/53 |
| 3,310,353 | 3/1967 | Cordis | 118/43 |
| 3,707,945 | 1/1973 | Boone | 118/200 |
| 3,910,229 | 10/1975 | Spencer | 118/325 |
| 4,069,789 | 1/1978 | Fukagawa et al. | 118/43 |
| 4,422,585 | 12/1983 | Schultz et al. | 242/55.53 |
| 4,620,502 | 11/1986 | Kimble | 118/43 |
| 4,756,485 | 7/1988 | Bastian et al. | 242/55.53 |

*Primary Examiner*—Willard E. Hoag

[57] ABSTRACT

A paper towel dispenser is disclosed having a towel spool and feed roll mounted on a pivoted front member of the dispenser housing. When the front member is in closed position to the feed roll can engage a portion of towel between the feed roll and a rotatable coating roller which is mounted in a coating container.

1 Claim, 2 Drawing Sheets

TOWEL COATER AND DISPENSER

BACKGROUND OF THE INVENTION (2) Field of the Invention:

This invention relates to a device for storing and dispensing an absorbent web such as roll paper or other rolls of material adapted for use in personal hygiene. Briefly, the invention comprises a device to dispense an absorbent web such as rolls of absorbent material having the properties of disposable paper towels, cloth-like material, and certain roll toilet tissue having the desired wet strength, which has been impregnated during the delivery process with a fluid deposit of active chemicals. The fluid may or may not be scented; it may or may not be antiseptic; it may be with or without healing properties.

(2) Description of the Prior Art:

All known prior art in the area requires the operation of motors, or gears, or levers, or spring tension type mechanical devices, to be able to extract the web after it is wetted thus increasing the economic cost. All the known prior art has complicated methods of inserting new web into the various devices to replenish the supply. Replacing the web in this invention is almost as simple as replacing a roll of toilet paper on a conventional home bathroom dispenser.

SUMMARY

This invention differs from known prior art in the area by the use of a roll which holds the absorbent material being pulled against the applicator roll in the applicator holding tray during the extraction process. As the absorbent material is pulled from its roll holder, the roll forces the absorbent material onto the applicator roll. The applicator roll is in a fixed position at the top of the applicator holding tray with its approximate lower one-half being immersed in the fluid. As the absorbent material is pulled it causes the applicator roll to turn and deliver fluid to the absorbent material being held against it by the opposing roll. No other known art in the area uses this method of application.

BRIEF DESCRIPTION OF THE DRAWING

The invention is more particularly described by reference to the accompanying drawing wherein.

DESCRIPTION OF THE PREFERRED EMBODIMENT

Figure 1:
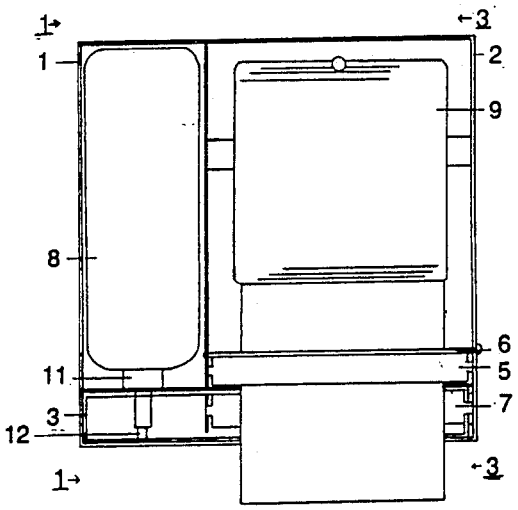
FIG. 1 is a vertical sectional view taken along line 2—2 of FIG. 2.
Figure 2:
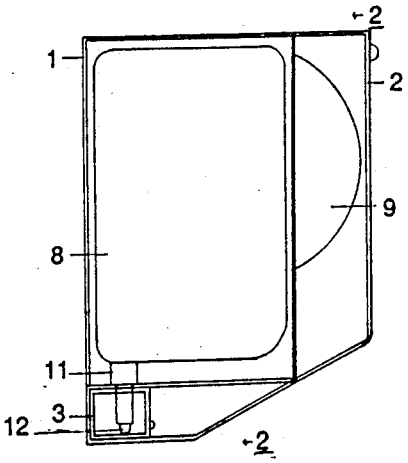
FIG. 2 is a vertical sectional view taken along line 1—1 of FIG. 1.
Figure 3:
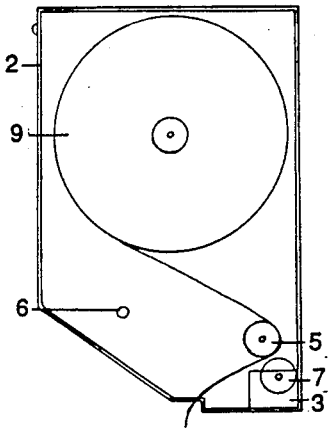
FIG. 3 is a vertical sectional view taken along line 3—3 of FIG. 1.
Figure 4:
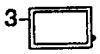
FIG. 4 is a vertical sectional view taken along line 1—1 of FIG. 5.
Figure 5:
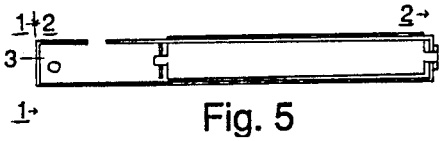
FIG. 5 is a vertical sectional view of the applicator holding tray taken along line 2—2 of FIG. 2.
Figure 6:
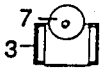
FIG. 6 is a vertical sectional view of the applicator holding tray taken along line 3—3 of FIG. 1.
Figure 7:
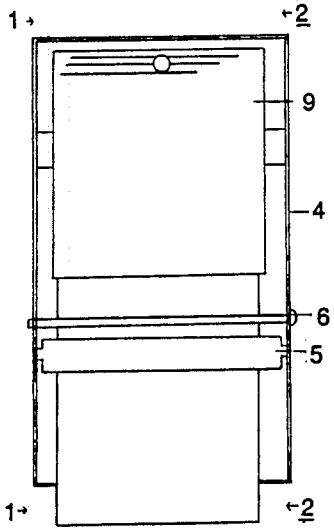
FIG. 7 is a vertical sectional view taken along line 2—2 of FIG. 2. of the inner insert of FIG. 1.
Figure 8:
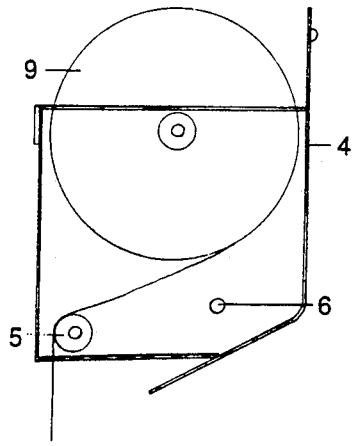
FIG. 8 is the vertical sectional view of the inner insert taken along line 1—1 of FIG. 7.
Figure 9:
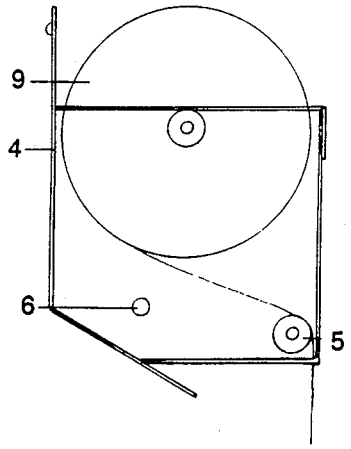
FIG. 9 is the vertical sectional view of the inner insert taken along line 2—2 of FIG. 7.
Figure 10:
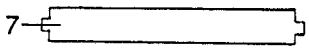
FIG. 10 is a vertical sectional view of the applicator holding tray roll.
Figure 11:
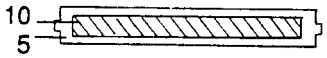
FIG. 11 is the vertical sectional view of roll 5.
Figure 12:
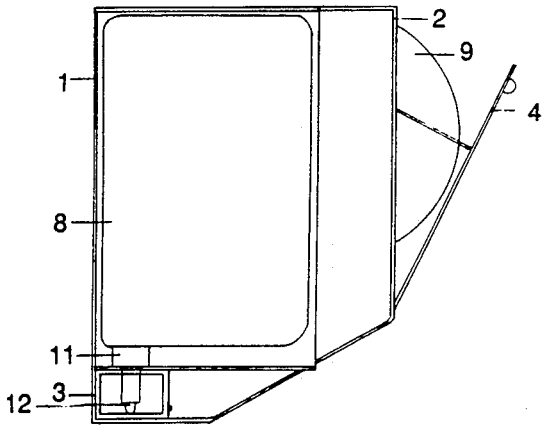
FIG. 12 is a vertical sectional view taken along line 1—1 of FIG. 1 showing the inner insert partially open.
Figure 13:
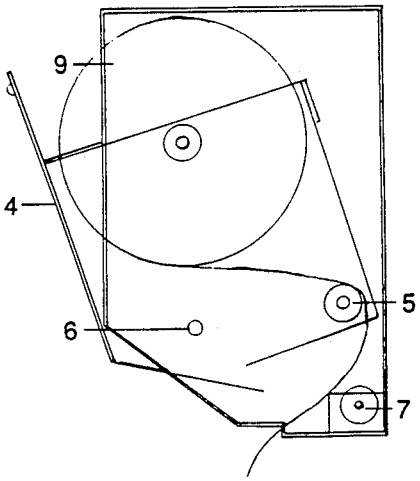
FIG. 13 is a vertical sectional view taken along line 3—3 of FIG. 1 showing the inner insert partially open.
Figure 14:
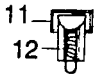
FIG. 14 is an opened vertical sectional view of the conventional dispenser cap used on the bottle-type fluid dispensing container.

Referring to FIG. 1, the roll of absorbent material 9 is located on a roll in the insert 4 which pivots out of the shell 1. This pivoting movement allows introduction of the roll of absorbent material onto its roll. The absorbent material is threaded or placed behind roll 5 and as the insert 4 is pivoted back into the shell 1, roll 5 drops and holds the absorbent material against the applicator roll 7 in the fluid applicator holding tray 3. The movement of the inner insert (inner holding shell) from the positions of FIGS. 2 or 3 to the position of FIG. 1 causes the roll 5 to engage the absorbent web between rolls 5 and 7. Roll 5 is free-floating and self aligning by means of each end of the roll being inserted in slightly larger oval-shaped or round holes in each side of the inner insert 4. As the absorbent material is pulled off its roll, the applicator roll 7 turns in the fluid in the applicator holding tray (3) and transfers fluid to the absorbent material held against it by roll 5. The absorbent material is extracted solely by the manual action of pulling the absorbent material from its roll.

We claim:

1. A device for dispensing a web of absorbent material and coating said material, comprising: A housing having a bottom and a support means being mounted in said housing, a second roll in said support means rotatively mounted such that said second roll is movable away from and towards a coating roll mounted in a coating chamber at the bottom of said housing, the material being engaged between the coating roll and said second roll when said support means has a position in said housing such that the second roll is at the nearest position to the coating roll that it is capable of occupying.

* * * * *